US008777592B2

(12) United States Patent
Nguyen

(10) Patent No.: US 8,777,592 B2
(45) Date of Patent: Jul. 15, 2014

(54) DISPENSING PUMP HAVING PISTON ASSEMBLY ARRANGEMENT

(75) Inventor: Hy Nguyen, Upland, CA (US)

(73) Assignee: Saint-Gobain Performance Plastics Corporation, Aurora, OH (US)

( * ) Notice: Subject to any disclaimer, the term of this patent is extended or adjusted under 35 U.S.C. 154(b) by 667 days.

(21) Appl. No.: 12/834,789

(22) Filed: Jul. 12, 2010

(65) Prior Publication Data

US 2011/0008189 A1 Jan. 13, 2011

Related U.S. Application Data

(60) Provisional application No. 61/225,199, filed on Jul. 13, 2009.

(51) Int. Cl.
*F04B 43/073* (2006.01)
*F04B 43/02* (2006.01)
*F04B 53/16* (2006.01)

(52) U.S. Cl.
USPC ..... 417/393; 417/46; 417/385; 92/98 D; 92/99

(58) Field of Classification Search
CPC .... F04B 43/0063; F04B 43/06; F04B 43/073; F04B 2201/0201
USPC ..... 417/383–385, 46, 568, 393, 395; 92/98 D, 99
See application file for complete search history.

(56) References Cited

U.S. PATENT DOCUMENTS

| | | | | |
|---|---|---|---|---|
| 3,672,791 | A * | 6/1972 | Zimmerly | 417/205 |
| 6,000,416 | A * | 12/1999 | Kingsford et al. | 137/1 |
| 6,079,959 | A * | 6/2000 | Kingsford et al. | 417/393 |
| 6,568,926 | B1 * | 5/2003 | Mount | 417/568 |
| 6,663,360 | B1 * | 12/2003 | Kyer | 417/399 |
| 6,790,010 | B2 * | 9/2004 | Chen et al. | 417/46 |
| 7,335,003 | B2 * | 2/2008 | Kingsford et al. | 417/417 |
| 2009/0260516 | A1 | 10/2009 | Fukui et al. | |

FOREIGN PATENT DOCUMENTS

| | | | |
|---|---|---|---|
| GB | 1498610 | A | 1/1978 |
| JP | 59-122789 | | 7/1984 |
| JP | 59-122790 | | 7/1984 |
| JP | 60-081486 | | 5/1985 |
| JP | 61-003985 | U | 1/1986 |
| JP | S61-3985 | U | 1/1986 |
| JP | S62-153406 | U | 9/1987 |
| JP | H0124387 | Y2 | 7/1989 |
| JP | H0261377 | A | 3/1990 |
| JP | 2000-514525 | A | 10/2000 |

(Continued)

*Primary Examiner* — Nathan Zollinger

(74) *Attorney, Agent, or Firm* — Abel Law Group, LLP; Chi Suk Kim

(57) ABSTRACT

A pump includes a pump body defining a fluid chamber and inlet and outlet ports in fluid communication with the fluid chamber, an inlet check valve connected to the inlet port, an outlet check valve connected to the outlet port, and a piston housing coupled to the pump body and defining a piston chamber. A piston assembly is disposed at least partially within the piston chamber and at least partially within the fluid chamber and includes a piston and a poppet connected to the piston in proximity to the pump body. In addition, the pump includes a gland disposed between a portion of the piston housing and the pump body. Further, the pump includes the poppet having a poppet head axially connected to a diaphragm coupled to a poppet flange. The poppet head is connected to the piston.

19 Claims, 4 Drawing Sheets

(56) References Cited

FOREIGN PATENT DOCUMENTS

| | | | |
|---|---|---|---|
| JP | 2008057752 A | 3/2008 | |
| KR | 10199900673 | 1/1999 | |
| WO | 9802659 | 1/1998 | |

* cited by examiner

DISPENSING PUMP HAVING PISTON ASSEMBLY ARRANGEMENT

CROSS-REFERENCE TO RELATED APPLICATION(S)

The present application claims priority from U.S. Provisional Patent Application No. 61/225,199, filed Jul. 13, 2009, entitled "DISPENSING PUMP," naming inventor Hy Nguyen, which application is incorporated by reference herein in its entirety.

FIELD OF THE DISCLOSURE

This disclosure, in general, relates to dispensing pumps and methods for their use.

BACKGROUND

Various industries rely on the dispensing of small volumes of fluid. In industries such as the semiconductor industry, small volumes of highly corrosive components are dispensed during processing of semiconductor devices. In industries such as the pharmaceutical industry, small volumes of solutions including concentrated ingredients are dispensed.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DESCRIPTION OF THE DRAWING(S)

Figure 1A:
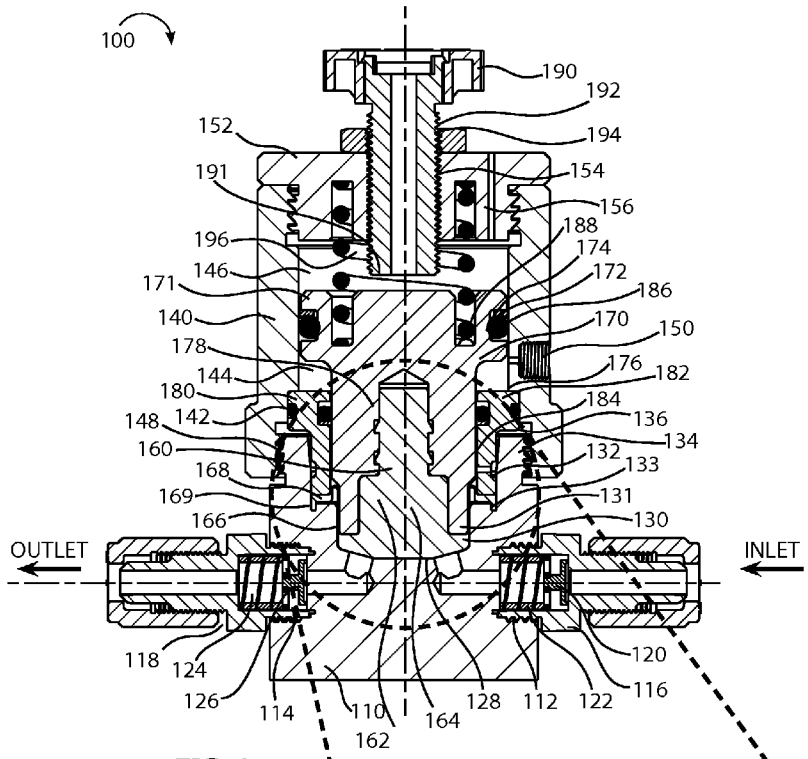
FIG. 1*a* includes an illustration of a cross-section of an exemplary dispensing pump in a closed configuration.
Figure 1B:
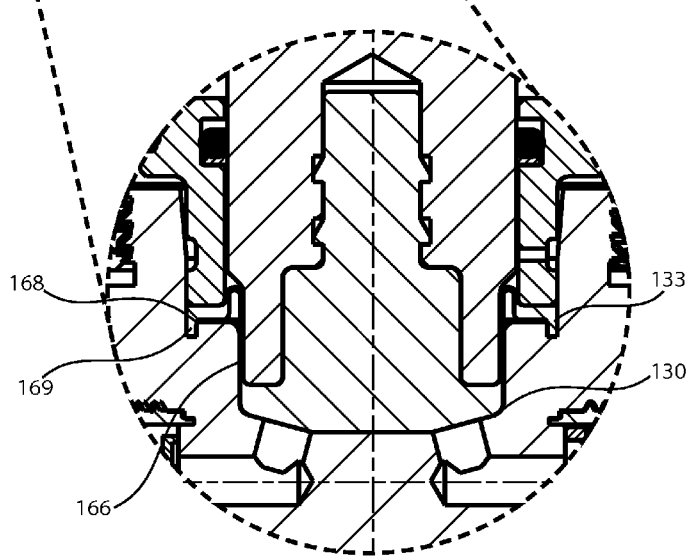
FIG. 1*b* includes a detailed illustration of the cross-section of the exemplary dispensing pump in the closed configuration.
Figure 1C:
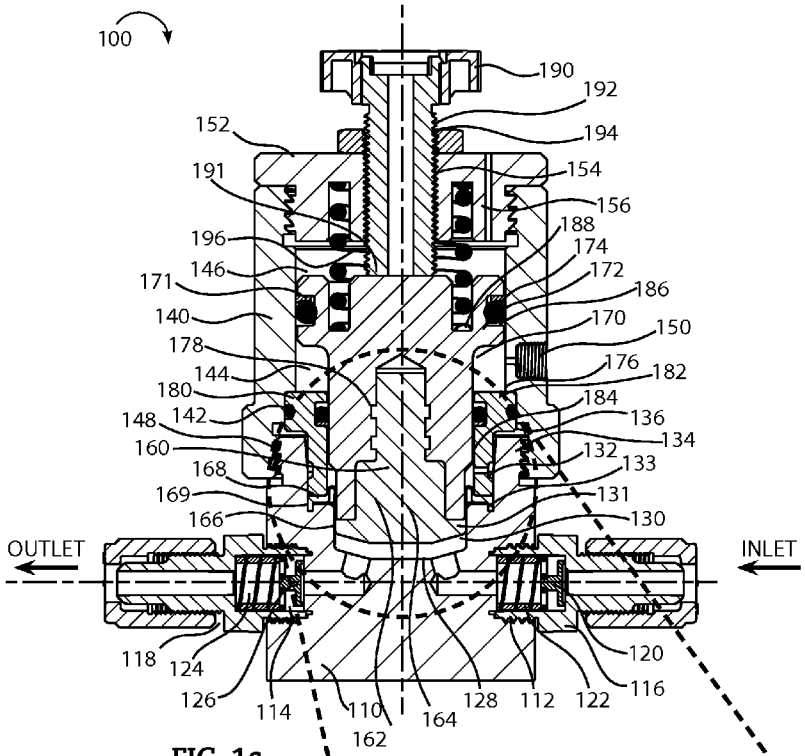
FIG. 1*c* includes an illustration of a cross-section of the exemplary dispensing pump in an open configuration.
Figure 1D:
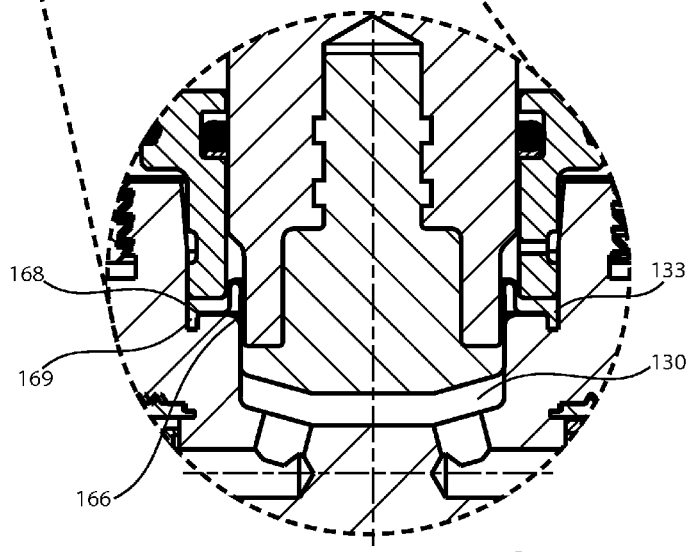
FIG. 1*d* includes a detailed illustration of the cross-section of the exemplary dispensing pump in the open configuration.

In a particular embodiment, a pump includes a pump body defining a fluid chamber and inlet and outlet ports. When a poppet disposed within the fluid chamber moves in a first direction, fluid is drawn through an inlet check valve coupled with the inlet port, and when it moves in a second direction, fluid is pushed out of the fluid chamber and through an outlet check valve. The inlet check valve can be directly connected to the pump body in line with the inlet port defined by the pump body. The outlet check valve can be directly connected to the pump body in line with the outlet port of the pump body. A piston is attached to the poppet and is disposed within a piston chamber. In response to actuating gas, such as air, the piston moves, actuating the poppet and causing fluid to flow within the fluid chamber. In addition, the pump can include a dispensed volume control, a piston rate control, and access ports to various volumes within the piston chamber to detect leakage.

In an exemplary embodiment, FIG. 1 includes an illustration of a dispensing pump 100 in an empty configuration. The dispensing pump 100 includes a pump body 110 connected to a piston housing 140. The pump body 110 defines a fluid chamber 130 circumscribed by inner annular walls 131 and 132. In addition, the pump body 110 defines an inlet port 112 and an outlet port 114. A piston assembly 160 is disposed within a piston chamber 146 defined by piston housing 140 and within the fluid chamber 130 of the pump body 110. In addition, a check valve 116 is directly connected to the fluid inlet port 112, and a check valve 118 is directly connected to the fluid outlet port 114. When the piston assembly 160 moves away from the seat 128 of the pump body 110, the check valve 116 opens permitting fluid to be drawn into the fluid chamber 130 and the check valve 118 is in a closed position. When the piston assembly 160 is moved toward the seat 128, fluid within the fluid chamber 130 increases in pressure to open the check valve 118 and close the check valve 116. Accordingly, fluid within the fluid chamber 130 is pushed out of the outlet port 114 of the pump body 110.

The pump body 110 includes a fluid chamber 130 defined by inner annular wall 131, inner annular wall 132, and the seat 128 disposed at an end of the fluid chamber 130. An inlet port 112 is defined in fluid communication with the fluid chamber 130. A check valve 116 is directly connected to and has fluid communication with the inlet port 112 and the fluid cavity 130. In particular, the check valve 116 directly contacts the pump body 110 without intervening tubes or connectors. The inlet check valve 116 includes an inlet check valve piston assembly 120 connected to a motivation component 122, such as a spring. The inlet check valve piston assembly 120 and the motivation component 122 are configured to permit fluid to enter the inlet port 112 and the fluid chamber 130 but not to exit the fluid chamber 130 via the fluid inlet port 112. The outlet port 114 is in fluid communication with the fluid chamber 130. In addition, a check valve 118 is directly connected to the fluid outlet port 114, such as without intervening tubes or connectors. The outlet check valve 118 includes an outlet check valve piston assembly 126 and motivation component 124 configured to permit fluid to flow from the fluid chamber 130, out of the outlet port 114 and through the check valve 118, but not in the opposite direction.

The check valve 116 and the check valve 118 can include components, such as polymer components or metal components. In a particular example, the check valves 116 and 118 include polymer components that can withstand corrosive environments. In a particular example, components of the inlet check valve 116 and the outlet check valve 118 can be formed of a fluoropolymer. In particular, the check valves 116 or 118 can be formed of a fluoropolymer, such as a polytetrafluoroethylene (PTFE) or perfluoroalkoxy (PFA), any blend or copolymer thereof, or any combination thereof.

Figure 3:
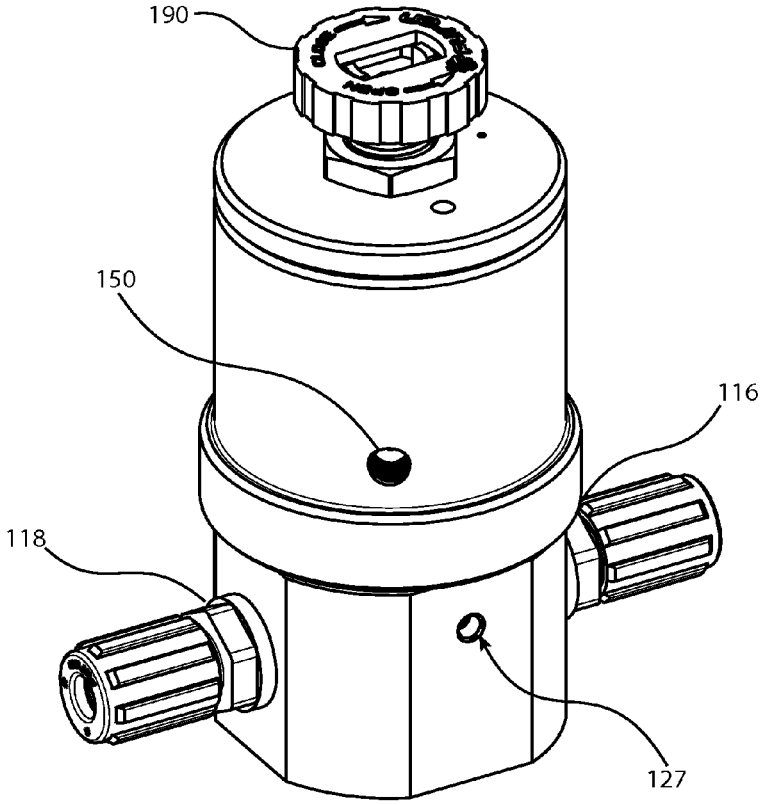
FIG. 3 includes an illustration of a perspective view of an exemplary dispensing pump.

In a particular example, the inlet port 112 and the outlet port 114 are in fluid communication with a seat 128 defined by the pump body 110 at an end of the fluid chamber 130. The seat 128 can extend radially beyond the location at which the fluid inlet and outlet ports 112 and 114 communicate with the fluid chamber 130. The fluid chamber 130 is defined by a first annular wall 131 and a second annular wall 132. The first annular wall 131 is disposed axially closer to the seat 128 than the second annular wall 132. The second annular wall 132 has a greater radial distance from the center line of the pump 100 than the first annular wall 131. In addition, the pump body 110 includes an annular groove 133. As illustrated in FIG. 1, the annular groove 133 is aligned with the annular wall 132 and is configured to engage a tongue 169 of a poppet 162. In addition, the pump body 110 may include a leak detection access 127, as illustrated in FIG. 3.

The pump body 110 can be formed of a polymer or metal material. In a particular example, the pump body 110 is formed of a polymeric material, such as a polymeric material resistant to corrosive solutions. For example, the pump body 110 can be formed of a fluoropolymer. In a particular example, the pump body 110 can be formed of polytetrafluoroethylene (PTFE) material, a PFA material, a blend or copolymer thereof, or any combination thereof.

The pump body 110 is connected to a piston housing 140. For example, the pump body 110 can include a threaded connection 134 at an end 136, which engages a threaded connection 148 of the piston housing 140. The piston housing 140 defines a piston chamber 146 in which a piston assembly 160 is disposed. The piston housing 140 can also include a shoulder 142 to engage a gland 180. In particular, the gland 180 includes a head 182 that is engaged between the piston housing 140 and the pump body 110.

The piston housing 140 also includes an actuation pressure port 150, which is in fluid communication with actuating volume 144. The actuating volume 144 is defined between a flange 171 of the piston assembly 160 and the gland 180. When actuating gas, such as air, is provided to the actuation volume 144, the piston assembly 160 is moved in a direction away from the seat 128 of the pump body 110. When the actuating gas is released from the actuation volume 144, the piston assembly 160 is moved in a direction towards the seat 128 of the pump body 110.

In addition, the dispensing pump 100 includes a casing end 152 coupled to the piston housing 140 at an end of the piston housing 140 opposite the pump body 110. In an example, the casing end 152 can be coupled to the piston chamber 140 using a threaded connection. In addition, the casing end 152 can provide access to the piston chamber 146 for a volume control bolt 190. In an example, the bolt 190 is threaded into a bore 154 of the top 152. The bolt 190 can include fine threads 192.

The gland 180 is an annular structure defining a central bore through which the piston assembly 160 extends. The gland 180 includes a head 182 and an annular arm 184. The head 182 is disposed between the piston housing 140 and the pump housing 110 and can be secured between the two by compression. The annular arm 184 extends along the second chamber wall 132 of the pump housing 110. In addition, the gland 180 includes annular cavities 186 and 188 within which seals can extend annularly in contact with the piston assembly 160 or the piston housing 140. In particular, the gland 180 secures a flange 168 of a poppet 162 against the pump body 110, such as axially between the gland 180 and the pump body 110.

The piston assembly 160 includes a poppet 162 in communication with the fluid chamber 130. The poppet 162 includes a head 164. The head 164 extends to contact the seat 128 of the pump body 110 and into a cavity 178 of the piston 170. In an example, the head 164 is radially coextensive with the seat 128. A diaphragm portion 166 of the poppet 162 extends axially from an edge of the head 164 to a flange 168 that extends radially from the diaphragm portion 166. The flange 168 can be secured between the pump body 110 and the gland 180. Further, the flange 168 can be configured to engage the annular groove 133. For example, the flange 168 can include a tongue 169 that extends within the annular groove 133. The diaphragm portion 166 of the poppet 162 is configured to roll along or rollingly engage an interior surface of the annular arm 184 of the gland 180 in response to movement of the piston 170. In a particular example, the poppet 162 is formed of a polymeric material such as a polymeric material that is resistant to corrosive chemical species. For example, the poppet 162 can be formed of a fluoropolymer, such as a PTFE. In particular, the PTFE can be a high fatigue PTFE, which exhibits 3 times the flexing of conventional PTFE.

The poppet 162 extends and locks into a cavity 178 of the piston 170 and is coupled to the piston 170. At a flanged end 171 of the piston 170 disposed on an opposite end of the piston 170 from the pump housing 110, an annular cavity 172 is disposed in which a seal 174 can be disposed. In addition, the piston 170 can include an annular cavity 176 to engage a motivator 196, such as a spring. The flanged end 171 of the piston 170 defines an actuator volume 144 between the flanged end 171 of the piston 170 and the gland 180 within the piston housing 140.

The volume that is dispensed can be controlled using a volume control including the volume control bolt 190. For example, the bolt 190 can engage, e.g., using a fine-toothed threaded connection 192, the casing end 152 of the pump. When the bolt 190 is engaged and rotated, the terminal end 191 of the bolt 190 can move relative to the pump body 110. As a result, as the piston assembly 160 is moved upwardly by actuating gas within the chamber 144, the extent to which the piston assembly 160 can move is determined based on a positioning of the terminal end 191 of the bolt 190. In other words, the positioning of the terminal end 191 of the bolt 190 determines the stroke length of the piston and thus, the volume of the fluid chamber 130 when in a full configuration. As such, the bolt 190 can be adjusted to increase or decrease the volume that can be dispensed. For example, the system can be configured to dispense a volume of fluid having a maximum value in a range of 5 cc to 30 cc. For example, the range can be between 5 cc and 20 cc, such as between 5 cc and 15 cc, or even a range of 5 cc to 10 cc. The bolt 190 can be moved to set how much of the maximum volume can be dispensed per stroke. For example, in a system having a 10 cc maximum value, the bolt 190 can be set to limit the dispensed volume to a value in the range of 0 cc to 10 cc. Once the bolt 190 is set, a nut 194 can be used to secure the position of the bolt 190 to the casing end 152 of the pump and limit further movement of the bolt 190. As used herein, the pump 100 is in an empty configuration when the poppet head 164 is in contact with the seat 128 and is in a full configuration when the piston assembly 160 is in contact with the bolt 190 or the casing end 152.

Figure 2:
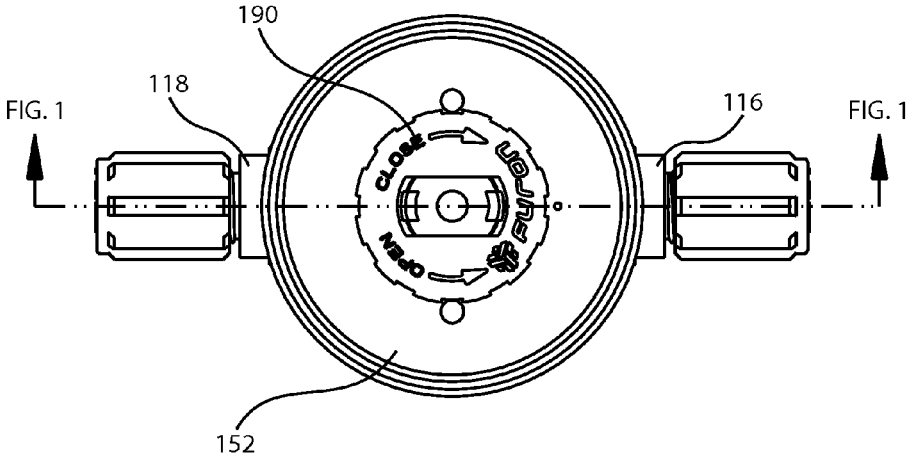
FIG. 2 includes an illustration of a top view of an exemplary dispensing pump.

FIG. 2 includes an illustration of a top view of an exemplary device. As illustrated in FIG. 2, the inlet check valve 116 and inlet port 112 are in radial alignment with the outlet port 114 and outlet check valve 118. Alternatively, the inlet and outlet ports 112 and 114 and inlet and outlet check valves 116 and 118 can be offset by an amount, such as between 0° and 90° from each other. As further illustrated in FIG. 2, counterclockwise movement of the bolt 190 can increase the volume that can be dispensed from the pump in accordance with a particular embodiment. In such a particular embodiment, clockwise rotation of the piston 190 results in a decrease in the volume that can be dispensed from the pump per stroke.

FIG. 3 includes a perspective view of the exemplary dispensing pump. As illustrated in FIG. 3, access 150 to the piston chamber 146 can be provided through the casing end 152 of the pump.

In operation, the piston assembly 160 is moved in a direction away from the seat 128 of the pump body 110 in response to an actuating gas entering the actuation pressure port 150. The actuating gas can enter actuation volume 144 and actuate the piston 170 to move in a direction towards the casing end 150, stopping once the casing end 152 is reached or a terminal end of the bolt 190 is contacted. As the piston assembly 160 moves, the diaphragm portion 166 of the poppet 162 rolls into contact with an annular arm 184 of the gland 180. In addition, movement of the piston assembly 160 causes a decrease in pressure in the fluid chamber 130, opening the check valve 116 and allowing fluid to flow into the fluid chamber 130. Once an appropriate amount of fluid fills the fluid chamber 130, the actuating gas can be removed from the actuator volume 144. The piston assembly 160 moves in the direction opposite of the casing end 152 moved by the motivator 196. Fluid within the fluid chamber 130 is driven against check valves 116 and 118. The change in pressure causes the inlet check valve 116 to close and the outlet check valve 118 to open, permitting fluid to flow out of the outlet port 114.

Figure 4:
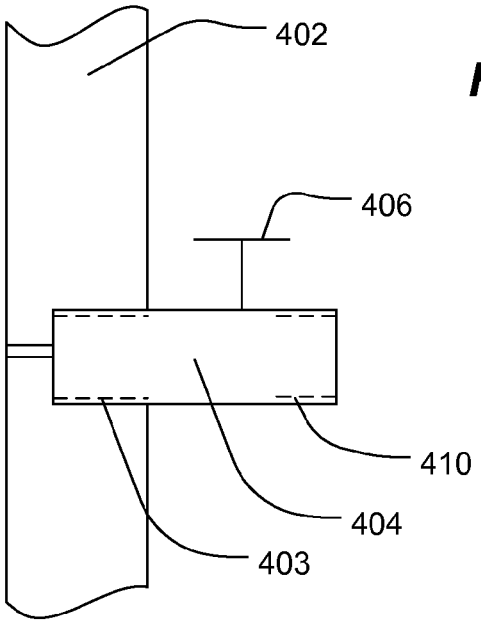
FIG. 4 includes an illustration of a cross-section of a portion of an exemplary dispensing pump.

The rate at which the piston assembly 160 moves can be manipulated or controlled based on the rate of actuating gas (e.g., air, $N_2$) provided to the actuator volume 144. As illustrated in FIG. 4, a piston housing 402 can include an actuation pressure port 403. A piston rate controller 404, such as a needle valve, can be directly connected to the piston housing 402, such as without intervening connectors or tubing. The piston rate controller 404 includes a connection portion 410 to secure the controller 404 to an actuating gas source. In addition, the controller 404 can include an adjustable element 406 to control the volume or rate of actuating gas transferred from the actuating gas source to the actuator volume. For example, the controller 404 can be a needle valve including a handle that when rotated changes the rate of actuating gas that can pass through the controller 404, and thus, the rate at which the piston 170 moves.

In a particular example, the above design provides for an increased life span dispensing pump. Materials can be chosen to form the dispensing pump such that the pump can be useful in ambient temperatures between 0° C. and 50° C., such as between 0° C. and 40° C. Further, the pump can handle media having a temperature in the range of 5° C. to 82° C., such as a range of 5° C. to 65° C., or even a range of 5° C. to 40° C. Pump actuation can be performed using at least a 60 psig actuating gas and the pump can have a maximum setting of 80 psig. In a particular example, a check valve can be selected which has a low opening pressure, such as not greater than 2 psig, not greater than 1 psig, or even not greater than 0.5 psig. Further, the check valve can seat with a pressure, such as not greater than 5 psig, not greater than 4 psig, or even not greater than 3 psig.

EXAMPLE

An exemplary pump configured as described above is tested using a cycle time of 3 seconds on and 3 seconds off running continuously. The actuation air pressure is 70 psig and the ambient temperature is 22° C. The media being pumped is room temperature water, which is suction lifted from 12 inches and dispensed back into the same flask. The chamber is set to dispense 10 cc water at 70 psig.

The pump passed the test, performing for at least 500,000 cycles without failure. As such, the pump exhibited unexpected durability and performance.

In a first embodiment, a pump includes a pump body defining a fluid chamber and inlet and outlet ports in fluid communication with the fluid chamber, an inlet check valve directly connected to the inlet port and to permit fluid flow into the inlet port, an outlet check valve directly connected to the outlet port and to permit fluid flow out of the outlet port, a piston housing coupled to the pump body, the piston housing defining a piston chamber, a piston assembly disposed at least partially within the piston chamber and at least partially within the fluid chamber, a gland disposed between a portion of the piston housing and the pump body, and a poppet having a poppet head axially connected to a diaphragm coupled to a poppet flange. An actuating volume of the piston chamber is defined between the flange of the piston and the gland. The piston assembly includes a piston and the poppet connected to the piston in proximity to the pump body. The piston includes a flange at an end of the piston opposite the poppet. The poppet head is connected to the piston. The poppet flange is disposed axially between the gland and the pump body. The diaphragm rollingly engages the annular arm of the gland in response to movement of the piston.

In an example of the first embodiment, the pump further includes a seat disposed at an end of the fluid chamber. The inlet and outlet ports are in fluid communication with the fluid chamber through openings in the seat. The fluid chamber can be circumscribed by first and second inner walls of the pump body. The first inner wall can be disposed axially closer to the seat than the second inner wall and the second inner wall can have a greater radial distance from a center line of the pump than the first inner wall. The gland can include a head disposed between the piston housing and the pump body and can include an annular arm extending along the second inner wall of the pump body. The poppet flange can be disposed between the annular arm of the gland and the pump body.

In a further example of the first embodiment, the flange of the poppet includes a tongue disposed in an annular groove of the pump body aligned with the second inner wall.

In another example of the first embodiment, the pump further includes a casing end connected to the piston housing at an end of the piston housing opposite the pump body. The casing end includes a threaded bore. The pump further includes a volume control that includes a bolt extending through the threaded bore of the casing end. A terminal end of the bolt can contact the piston and limit a stroke length of the piston.

In an additional example of the first embodiment, the pump further includes a piston rate controller in fluid communication with the actuating volume through the piston housing. The piston rate controller can be adjustable to control the rate of actuating gas to enter the actuating volume. The piston rate controller can include a needle valve directly connected to an access port of the piston housing.

In a second embodiment, a pump includes a pump body defining a fluid chamber and inlet and outlet ports in fluid communication with the fluid chamber, an inlet check valve connected to the inlet port and to permit fluid flow into the inlet port, an outlet check valve connected to the outlet port and to permit fluid flow out of the outlet port, and a piston housing coupled to the pump body. The piston housing defines a piston chamber. The pump further includes a piston assembly disposed at least partially within the piston chamber and at least partially within the fluid chamber. The piston assembly includes a piston and a poppet connected to the piston in proximity to the pump body. The piston includes a flange at an end of the piston opposite the poppet. The pump further includes a gland at least partially disposed between a portion of the piston housing and the pump body. An actuating volume of the piston chamber is defined between the flange of the piston and the gland. The pump also includes a piston rate controller in fluid communication with the actuating volume through the piston housing. The piston rate controller is adjustable to control the rate of actuating gas to enter the actuating volume. In addition, the pump includes the poppet having a poppet head axially connected to a diaphragm coupled to a poppet flange. The poppet head is connected to the piston. The poppet flange is disposed axially between the gland and the pump body. The diaphragm is to rollingly engage the gland in response to movement of the piston.

In an example of the second embodiment, the piston rate controller includes a needle valve directly connected to an access port of the piston housing.

In another example of the second embodiment, the gland includes an annular arm extending along an inner wall of the pump body. The flange of the poppet is disposed between the annular arm of the gland and the pump body. The diaphragm is to rollingly engage the annular arm of the gland.

In a third embodiment, a pump includes a pump body defining a fluid chamber and inlet and outlet ports in fluid communication with the fluid chamber. A seat is disposed at an end of the fluid chamber. The inlet and outlet ports are in fluid communication with the fluid chamber through openings in the seat. The seat has a diameter extending radially beyond the openings. The pump further includes an inlet check valve connected to the inlet port and to permit fluid flow into the inlet port, an outlet check valve connected to the outlet port and to permit fluid flow out of the outlet port, a piston housing coupled to the pump body, the piston housing defining a piston chamber, and a piston assembly disposed at least partially within the piston chamber and at least partially within the fluid chamber. The piston assembly includes a piston and a poppet connected to the piston in proximity to the pump body. The piston includes a flange at an end of the piston opposite the poppet. The pump further includes a gland disposed between a portion of the piston housing and the pump body. An actuating volume of the piston chamber is defined between the flange of the piston and the gland. The pump also includes the poppet having a poppet head axially connected to a diaphragm coupled to a poppet flange. The poppet head is connected to the piston and is to contact the seat in an empty position. The diaphragm is to rollingly engage the gland in response to movement of the piston.

In an example of the third embodiment, the poppet head is coextensive with the seat. In another example of the third embodiment, the gland includes an annular arm extending along an inner wall of the pump body. The flange of the poppet is disposed between the annular arm of the gland and the pump body. The diaphragm is to rollingly engage the annular arm of the gland.

In a fourth embodiment, a pump includes a pump body defining a fluid chamber and inlet and outlet ports in fluid communication with the fluid chamber. The fluid chamber is circumscribed by first and second inner walls of the pump body. A seat is disposed at an end of the fluid chamber. The inlet and outlet ports are in fluid communication with the fluid chamber through openings in the seat. The first inner wall is disposed axially closer to the seat than the second inner wall and the second inner wall has a greater radial distance from a center line of the pump than the first inner wall. The pump further includes an inlet check valve directly connected to the inlet port and to permit fluid flow into the inlet port, an outlet check valve directly connected to the outlet port and to permit fluid flow out of the outlet port, and a piston housing coupled to the pump body. The piston housing defines a piston chamber. The pump also includes a casing end connected to the piston housing at an end of the piston housing opposite the pump body. The casing end includes a threaded bore. The pump further includes a piston assembly disposed at least partially within the piston chamber and at least partially within the fluid chamber. The piston assembly includes a piston and a poppet connected to the piston in proximity to the pump body. The piston includes a flange at an end of the piston opposite the poppet. The pump includes a gland including a head disposed between a portion of the piston housing and the pump body and including an annular arm extending along the second inner wall of the pump body. An actuating volume of the piston chamber is defined between the flange of the piston and the head of the gland. The pump also includes a volume control including a bolt extending through the threaded bore of the casing end. A terminal end of the bolt is to contact the piston and limit a stroke length of the piston. The pump further includes a piston rate controller in fluid communication with the actuating volume through the piston housing. The piston rate controller is adjustable to control the rate of actuating gas to enter the actuating volume. The pump also includes the poppet having a poppet head axially connected to a diaphragm coupled to a poppet flange. The poppet head is connected to the piston. The poppet flange is disposed axially between the annular arm of the gland and the pump body. The diaphragm is to rollingly engage the annular arm of the gland in response to movement of the piston.

In a fifth embodiment, a method of dispensing a fluid includes drawing a fluid into a fluid chamber of a pump. The pump includes a pump body defining the fluid chamber and inlet and outlet ports in fluid communication with the fluid chamber, an inlet check valve directly connected to the inlet port and to permit fluid flow into the inlet port, an outlet check valve directly connected to the outlet port and to permit fluid flow out of the outlet port, and a piston housing coupled to the pump body. The piston housing defines a piston chamber. The pump further includes a piston assembly disposed at least partially within the piston chamber and at least partially within the fluid chamber. The piston assembly includes a piston and a poppet connected to the piston in proximity to the pump body. The piston includes a flange at an end of the piston opposite the poppet. The pump further includes a gland disposed between a portion of the piston housing and the pump body. An actuating volume of the piston chamber is defined between the flange of the piston and the gland. The pump includes the poppet having a poppet head axially connected to a diaphragm coupled to a poppet flange. The poppet head is connected to the piston. The poppet flange is disposed axially between the gland and the pump body. The diaphragm is to rollingly engage the annular arm of the gland in response to movement of the piston. The method further includes expelling the fluid from the fluid chamber through the outlet port following drawing.

In an example of the fifth embodiment, drawing includes applying gas to the actuating volume. In another example of the fifth embodiment, expelling includes releasing gas from the actuating volume. In a further example of the fifth embodiment, during drawing, the inlet check valve is in an open position and the outlet check valve is in a closed position, and during expelling, the inlet check valve is in a closed position and the outlet check valve is in an open position.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A pump comprising:

a pump body defining a fluid chamber, a seat disposed at an end of the fluid chamber, and an inlet port and an outlet port in fluid communication with the fluid chamber;

an inlet check valve directly connected to the inlet port and to permit fluid flow into the inlet port;

an outlet check valve directly connected to the outlet port and to permit fluid flow out of the outlet port;

a piston housing coupled to the pump body, the piston housing defining a piston chamber;

a piston assembly disposed at least partially within the piston chamber and at least partially within the fluid chamber, the piston assembly including a piston and a poppet connected to the piston in proximity to the pump body, the piston including a flange at an end of the piston opposite the poppet;

a gland disposed between a portion of the piston housing and the pump body, an actuating volume of the piston chamber defined between the flange of the piston and the gland; and the poppet having a poppet head axially connected to a diaphragm coupled to a poppet flange, the poppet head connected to the piston, the poppet flange disposed axially between the gland and the pump body, the diaphragm to rollingly engage an opposing surface in response to movement of the piston, wherein the seat of the pump body is configured such that the diaphragm can engage with the seat of the pump body at a point along an axis of the piston.

2. The pump of claim 1, wherein the inlet and outlet ports are in fluid communication with the fluid chamber through openings in the seat.

3. The pump of claim 2, wherein the fluid chamber is circumscribed by first and second inner walls of the pump body, the first inner wall disposed axially closer to the seat than the second inner wall and the second inner wall have a greater radial distance from a center line of the pump than the first inner wall.

4. The pump of claim 3, wherein the gland includes a head disposed between the piston housing and the pump body and includes an annular arm extending along the second inner wall of the pump body.

5. The pump of claim 4, wherein the poppet flange is disposed between the annular arm of the gland and the pump body.

6. The pump of claim 5, wherein the flange of the poppet includes a tongue disposed in an annular groove of the pump body aligned with the second inner wall.

7. The pump of claim 1, further comprising:

a casing end connected to the piston housing at an end of the piston housing opposite the pump body, the casing end including a threaded bore; and a volume control including a bolt extending through the threaded bore of the casing end, a terminal end of the bolt to contact the piston and limit a stroke length of the piston.

8. The pump of claim 1, further comprising a piston rate controller in fluid communication with the actuating volume through the piston housing, the piston rate controller adjustable to control the rate of actuating gas to enter the actuating volume.

9. The pump of claim 8, wherein the piston rate controller includes a needle valve directly connected to an access port of the piston housing.

10. The pump of claim 5, wherein the diaphragm is adapted to rollingly engage the annular arm of the gland in response to movement of the piston.

11. A pump comprising:

a pump body defining a fluid chamber, a seat disposed at an end of the fluid chamber, and an inlet port and an outlet port in fluid communication with the fluid chamber;

an inlet check valve connected to the inlet port and to permit fluid flow into the inlet port;

an outlet check valve connected to the outlet port and to permit fluid flow out of the outlet port;

a piston housing coupled to the pump body, the piston housing defining a piston chamber;

a piston assembly disposed at least partially within the piston chamber and at least partially within the fluid chamber, the piston assembly including a piston and a poppet connected to the piston in proximity to the pump body, the piston including a flange at an end of the piston opposite the poppet;

a gland at least partially disposed between a portion of the piston housing and the pump body, an actuating volume of the piston chamber defined between the flange of the piston and the gland;

the poppet having a poppet head axially connected to a diaphragm coupled to a poppet flange, the poppet head connected to the piston, the poppet flange disposed axially between the gland and the pump body, the diaphragm to rollingly engage an opposing surface in response to movement of the piston;

a casing end connected to the piston housing at and end of the piston housing opposite the pump body, the asing end including a threaded bore; and a volume control including a bolt extending through the threaded bore of the casing end, a terminal end of the bolt to contact the piston and limit a stroke length of the piston;

wherein the seat of the pump body is configured such that the diaphragm can engage with the seat of the pump body at a point along an axis of the piston.

12. The pump of claim 11, further comprising a piston rate controller in fluid communication with the actuating volume through the piston housing, the piston rate controller adjustable to control the rate of actuating gas to enter the actuating volume.

13. The pump of claim 12, wherein the piston rate controller comprises a needle valve directly connected to an access port of the piston housing.

14. The pump of claim 11, wherein the gland includes an annular arm extending along an inner wall of the pump body, the flange of the poppet disposed between the annular arm of the gland and the pump body, the diaphragm to rollingly engage the annular arm of the gland.

15. A method of dispensing a fluid, the method comprising:

drawing a fluid into a fluid chamber of a pump, the pump including:

a pump body defining the fluid chamber, a seat disposed at an end of the fluid chamber, and an inlet port and an outlet port in fluid communication with the fluid chamber;

an inlet check valve directly connected to the inlet port and to permit fluid flow into the inlet port;

an outlet check valve directly connected to the outlet port and to permit fluid flow out of the outlet port;

a piston housing coupled to the pump body, the piston housing defining a piston chamber;

a piston assembly disposed at least partially within the piston chamber and at least partially within the fluid chamber, the piston assembly including a piston and a poppet connected to the piston in proximity to the pump body, the piston including a flange at an end of the piston opposite the poppet;

a gland disposed between a portion of the piston housing and the pump body, an actuating volume of the piston chamber defined between the flange of the piston and the gland; and the poppet having a poppet head axially connected to a diaphragm coupled to a poppet flange, the poppet head connected to the piston, the poppet flange disposed axially between the gland and the pump body, the diaphragm to rollingly engage an opposing surface in response to movement of the piston, wherein the seat of the body pump is configured such that the diaphragm can engage with the seat of the pump body at a point along an axis of the piston; and expelling the fluid from the fluid chamber through the outlet port following drawing.

16. The method of claim 15, wherein drawing includes applying gas to the actuating volume.

17. The method of claim 15, wherein expelling includes releasing gas from the actuating volume.

18. The method of claim 15, wherein during drawing the inlet check valve is in an open position and the outlet check valve is in a closed position, and during expelling, the inlet check valve is in a closed position and the outlet check valve is in an open position.

19. A pump comprising:

a pump body defining a fluid chamber, a seat disposed at an end of the fluid chamber, and an inlet port and an outlet port in fluid communication with the fluid chamber;

an inlet check valve connected to the inlet port and to permit fluid flow into the inlet port;

an outlet check valve connected to the outlet port and to permit fluid flow out of the outlet port;

a piston housing coupled to the pump body, the piston housing defining a piston chamber;

a piston assembly disposed at least partially within the piston chamber and at least partially within the fluid chamber, the piston assembly including a piston having two ends with a poppet on the end of the piston in proximity to the pump and a flange at the end of the piston opposite the poppet;

a gland disposed between the flange of the piston and the seat of the pump body, actuating volume of the piston chamber defined between the flange of the piston and the gland; and the poppet end of the piston assembly having a poppet head axially connected to a diaphragm coupled to a poppet flange, the poppet head connected to the piston, the poppet flange disposed axially between the gland and the pump body, the diaphragm configured to rollingly engage an opposing surface in response to movement of the piston, wherein the seat of the pump body is configured such that the diaphragm can engage with the seat of the pump body at a point along an axis of the piston.

* * * * *